US007533777B2

(12) United States Patent
Winkler

(10) Patent No.: US 7,533,777 B2
(45) Date of Patent: May 19, 2009

(54) VARIABLE STORAGE SHELVING

(76) Inventor: Josef Winkler, Untergrafendorf 70, Boheimkirchen (AT) 3071

( * ) Notice: Subject to any disclaimer, the term of this patent is extended or adjusted under 35 U.S.C. 154(b) by 359 days.

(21) Appl. No.: 10/548,101

(22) PCT Filed: Feb. 27, 2004

(86) PCT No.: PCT/AT2004/000060

§ 371 (c)(1),
(2), (4) Date: Sep. 6, 2005

(87) PCT Pub. No.: WO2004/077997

PCT Pub. Date: Sep. 16, 2004

(65) Prior Publication Data

US 2006/0169660 A1 Aug. 3, 2006

(30) Foreign Application Priority Data

Mar. 3, 2003 (AT) ..... A 305/2003

(51) Int. Cl.
*A47B 43/00* (2006.01)

(52) U.S. Cl. ..... 211/201; 211/193

(58) Field of Classification Search ..... 211/189, 211/201, 195, 85, 13.1, 182, 191, 192, 193, 211/95, 96, 100, 104, 163, 167; 280/639, 280/651; 5/176.1, 182; 108/108, 115; 312/258; 248/164, 166, 431, 436
See application file for complete search history.

(56) References Cited

U.S. PATENT DOCUMENTS 3,240,505 A * 3/1966 Schlernitzauer ..... 280/651
4,094,417 A * 6/1978 Cairnes et al. ..... 211/183
4,202,278 A 5/1980 Wadenhed
4,349,213 A * 9/1982 Hirsch ..... 280/638
4,774,792 A * 10/1988 Ballance ..... 52/285.2
5,125,520 A * 6/1992 Kawasaki ..... 211/133.1
5,269,112 A * 12/1993 Weinrub et al. ..... 52/646
5,685,442 A 11/1997 Shimizu et al.
5,957,309 A * 9/1999 Hall ..... 211/126.2
6,419,098 B1 * 7/2002 Hall ..... 211/133.1
6,935,523 B2 * 8/2005 Ahn ..... 211/195
6,974,042 B2 * 12/2005 Hall ..... 211/133.1
D514,269 S * 1/2006 Polidoros ..... D34/21
7,185,899 B2 * 3/2007 Thiede et al. ..... 280/47.35

* cited by examiner

*Primary Examiner*—Jennifer E. Novosad
(74) *Attorney, Agent, or Firm*—Young & Thompson

(57) ABSTRACT

Storage shelving includes at least two base elements consisting of an essentially horizontal base support and several storage grilles, whose side rails are arranged substantially vertically and whose grille bars run substantially perpendicular to the side rails. The storage grilles can be displaced about the longitudinal axis of the rails or about an axis lying parallel to the rails in different angular positions and the two or more base elements are rigidly and detachably interconnected. At least two storage grilles having side rails adjoin one another on each base support and either both or all side rails are fixed to a rod that projects essentially vertically from the base support, or one side rail is fixed to the base support and the second or additional side rail(s) is/are fixed to the first side rail.

17 Claims, 2 Drawing Sheets

VARIABLE STORAGE SHELVING

FIELD OF THE INVENTION

The invention relates to a curing rack, especially for holding flat articles, such as sheets, battens, panels or the like, with the features cited in the preamble of claim 1.

DESCRIPTION OF THE RELATED ART

Conventionally, curing racks are used for curing workpiece parts (especially sheet materials) in furniture production, especially in surface drying after painting.

In order to achieve maximum versatility of these curing racks for the most varied sizes of parts to be laid down, curing racks with four support grids (four grid bars per tier) are used. These curing racks are generally set up on a rectangular or U-shaped base frame. One problem is the not inconsiderable amount of space required for these curing racks when they are not needed. Telescoping/stackable curing racks save space only starting with the second carriage. Curing racks with an adjustable length generally have only two support grids. Curing racks which have an adjustable length and four support grids are equipped with one or more crossbars which impart the necessary stability to it. These crossbars require additional operating effort when the length is being adjusted. Since they can project to the outside when the length has been adjusted to be shorter, under certain circumstances they also constitute a barrier to the operators.

In a curing rack with two essentially horizontal base supports and at least two support grids, mounting these supports grid with the ability to turn around the lengthwise axis of the grid crossbeams with a fixing capacity is already known (DE 1 909 391 A). When the curing rack is not in use the support grids can be swivelled in. This configuration likewise reduces of the amount of space required when the curing rack is not being used. In order to mount the support grids with a turning capacity, however a rectangular base frame is necessary, the grid crossbeams being hung with upper and lower axle pins in the corresponding holes in the upper and lower beam of the base frame.

SUMMARY OF THE INVENTION

The object of the invention is to offer a variable curing rack which is easy to operate, with four support grids, and at the same time to enable an extremely small space requirement when not in use. The support grids are to be mountable without the need for a base frame so that precautions for adjusting the length of the curing rack are not limited by the base frame.

As claimed in the invention, this object is achieved by the features given in the characterizing part of claim 1.

So that there is a suitable support possibility due to the support grids which are directly next to one another, they are mounted such that they can be moved into different angular positions by simple manipulation. This execution makes it possible to combine the advantages of curing racks which are built on a fixed base frame, specifically to offer four support bars per tier, with the advantages of curing racks with an adjustable length, specifically an extremely small space requirement when they are not being used. At the same time the curing rack is characterized by its great variability and ease of operation. Moreover the support area can be enlarged in length over the amount possible by the adjustment element by the grid bars which can be positioned to the outside.

Other advantageous embodiments are the subject matter of the dependent claims.

The invention and other details of the invention are explained using the embodiments shown in the drawings, without being limited thereto.

DETAILED DESCRIPTION OF THE PREFERRED EMBODIMENTS

The curing rack consists of at least two base components which each consist of one horizontal base support 01 and several attachable support grids. The support grids consist of one grid crossbeam 09 which is located perpendicular to the base support 01 and several grid bars 11 which are mounted essentially at a right angle to the grid crossbeam 09.

Figures 10, 11:
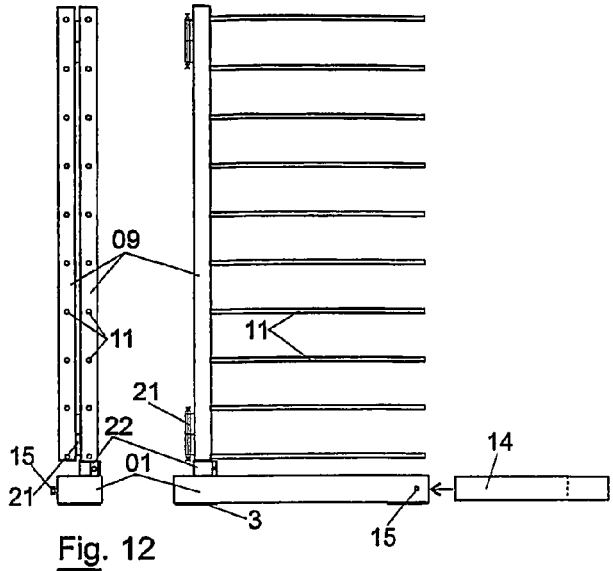
FIGS. 10-12 show the curing rack as claimed in the invention in a second embodiment.
Figure 12:
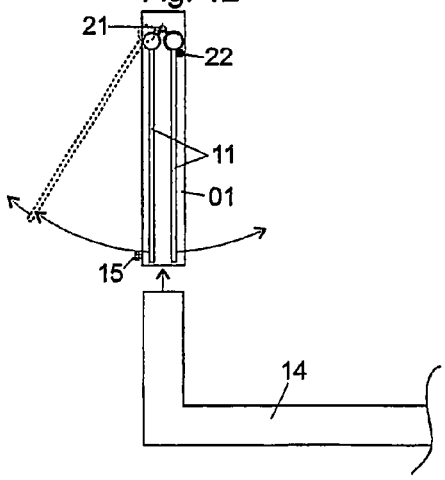
Figure 13:
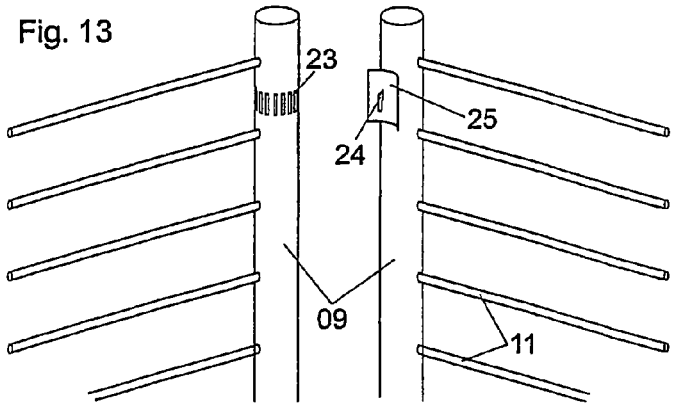
FIG. 13 shows details of the mounting of the support grids according to another embodiment.

In the first embodiment as shown in FIGS. 1-5, the support grids can be mounted by way of a vertical rod 02 which projects vertically upward and which is mounted on the base support 01 (FIG. 2, side view) Alternatively the support grids can be attached directly to the base support 01; attachment can be effected pivotally by means of a clamp 22; other support grids can be attached to this support grid (FIGS. 10-12).

On the ends of the horizontal base support 01 there are standing surfaces 03 or rollers 04 can be attached.

The base components are rigidly and detachably connected to one another; the connecting components are preferably made adjustable.

Figure 3:
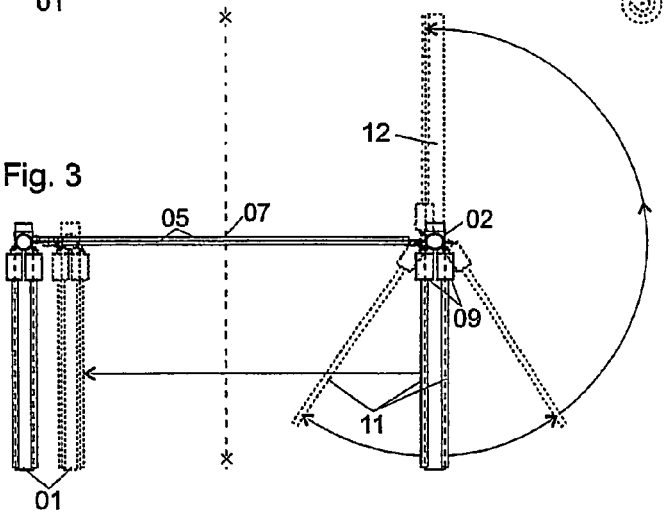
Figure 4:
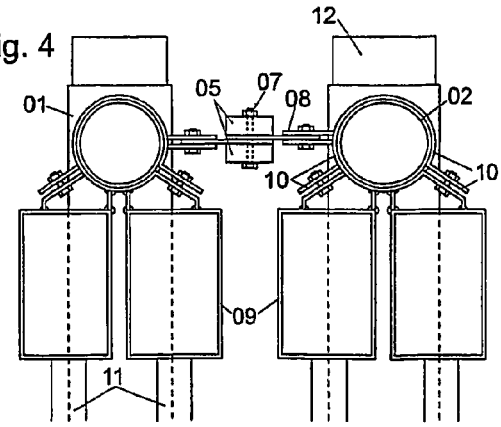
FIGS. 4 and 5 show details of the attachment of the support grids according to the first embodiment.
Figure 5:
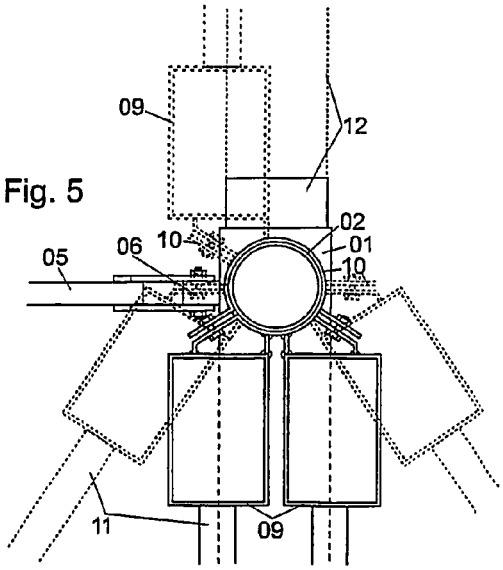

The grid crossbeams 09 are adjustably connected to the base support 01 such that the grid bars 11 can be positioned in different angular positions against one another (FIG. 3, top view) . This takes place preferably by means of clamps 10 which are welded on the grid crossbeam 09 and which can be clamped on the vertical rod 02 attached to the base support 01 or on the grid crossbeam 09 attached to the base support 01. The support grids can thus be continuously swivelled (FIG. 3 top view and FIG. 5 detailed extract—different attainable positions of the support grids are shown by the broken lines).

Other embodiments with which the support grids can be mounted on the vertical rod 02 attached to the base support 01 or to the grid crossbeam 09 which is attached to the base support 01 are:

A) By strap hinges 21 FIGS. (10-12).

B) By hooks 24 which fit into a row of eyes 23 (FIG. 10)

D) By screwing down, in which the screws can be attached in a row of threads (no figure).

The preferred execution of the connecting components of the base components are scissor braces 05 (FIG. 1—The broken lines show the position of the smallest adjustable distance of the base components to one another ) , they also keep the base components parallel during the adjustment process and can be fixed in different positions. The scissor braces 05 are preferably connected on the bottom end by means of a hinge 06 to the base components (FIG. 5 top view—the top half of the scissor braces 05 with the clamp is omitted in this representation). In the middle they are fixed against one another for example by means of an inserted screw 07. The top end can be fixed on a vertical guide rail in different positions. The preferred embodiment of top mounting consists in a clamp 08 which can be moved on the vertical rod 02 (FIG. 4 top view—the lower hinge is omitted in this representation).

Figure 6:
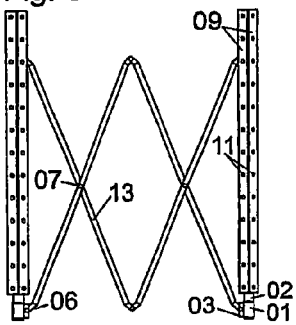
FIGS. 6-9 show different versions for connecting the base components.

Other embodiments for the connection of the base components are:

A) multiple scissor braces 13 (FIG. 6), here a greater distance of the base components to one another can be attained relative to the version with single scissor braces.

B) C-shaped spacer bars 14 (FIGS. 11+12) which can be inserted into sleeves which are mounted on the base components, and can be fixed for example by attachment screws 15. In the illustrated case the base support 01 is used as a sleeve. This version ensures fixed distances of the base components. These spacer bars can be made for example in different standard lengths.

Figure 7:
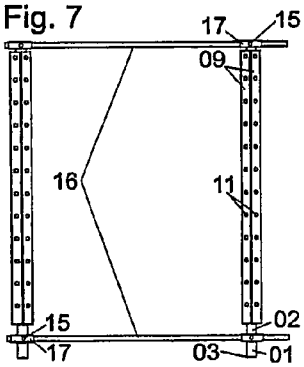

C) Straight spacer bars 16 (FIG. 7) which can be inserted into sleeves 17 on the base components and can be fixed for example by attachment screws 15.

Figure 8:
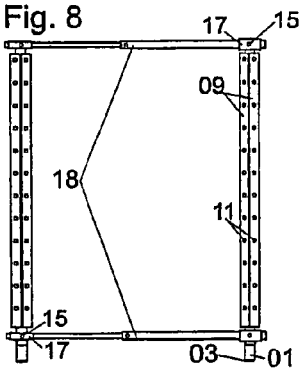

D) Spacer bars 18 which are made telescoping (FIG. 8).

Figure 9:
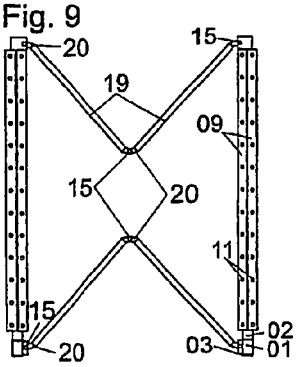

E) Articulated braces 19 (FIG. 9) where the articulations 20 can be fixed for example by attachment screws 15.

Figure 1:
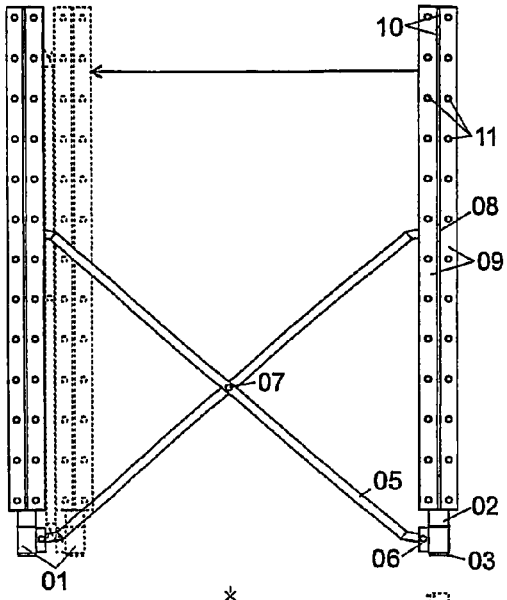
FIGS. 1-3 show the curing rack as claimed in the invention in a front, side and top view in a first embodiment.
Figure 2:
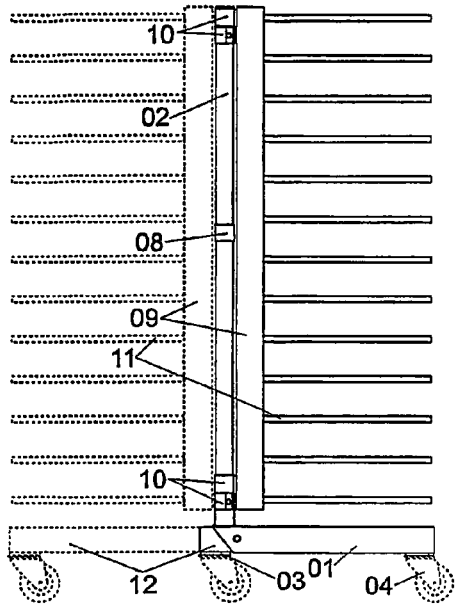

The base supports 01 are made telescoping in the area of the grid crossbeam attachment (FIG. 2—The telescoping base support 12 which has been pulled out and the support grids which are swivelled to the rear are shown by the broken lines). When the telescoping base supports 12 have been pulled out and the support grids have been swivelled to the rear the curing rack can be loaded on both sides without tipping (FIGS. 2 and 3).

The invention claimed is:

1. A curing rack, comprising:

a first horizontal base support (01) having a horizontal first base length;

a second horizontal base support (01) having a horizontal second base length, rigidly and detachably connected to the first horizontal base support (01);

a vertical first grid crossbeam (09) pivotally mounted to the first base support (01) to swivel about the first base support (01) in a first space in vertical registration with the first base length and around a first vertical axis running parallel to the first grid crossbeam;

a vertical second grid crossbeam, located directly adjacent to the first grid crossbeam, pivotally mounted to the first base support (01) to swivel about the first base support (01) in the first space in vertical registration with the base length and around a second vertical axis running parallel to the second grid crossbeam;

a first plurality of cantilever grid bars (11) mounted, at a right angle, to the first grid crossbeam; and a second plurality of grid bars (11) mounted, at a right angle, to the second grid crossbeam, wherein the first plurality of grid bars are cantilevers, each cantilever being attached at a first end to the first grid crossbeam.

2. A curing rack, comprising:

a first horizontal base support (01) having a horizontal first base length;

a second horizontal base support (01) having a horizontal second base length, rigidly and detachably connected to the first horizontal base support (01);

a vertical first grid crossbeam (09) pivotally mounted to the first base support (01) to swivel about the first base support (01) in a first space in vertical registration with the first base length and around a first vertical axis running parallel to the first grid crossbeam;

a vertical second grid crossbeam, located directly adjacent to the first grid crossbeam, pivotally mounted to the first base support (01) to swivel about the first base support (01) in the first space in vertical registration with the base length and around a second vertical axis running parallel to the second grid crossbeam;

a first plurality of cantilever grid bars (11) mounted, at a right angle, to the first grid crossbeam;

a second plurality of cantilever grid bars (11) mounted, at a right angle, to the second grid crossbeam;

a vertical third grid crossbeam (09) pivotally mounted to the second base support (01) to swivel about the second base support (01) in a second space in vertical registration with the second base length and around a third vertical axis running parallel to the third grid crossbeam;

a vertical fourth grid crossbeam, located directly adjacent to the third grid crossbeam, pivotally mounted to the second base support (01) to swivel about the second base support (01) in a second space in vertical registration with the second base length and around a fourth vertical axis running parallel to the fourth grid crossbeam;

a third plurality of cantilever grid bars (11) mounted, at a right angle, to the third grid crossbeam; and a fourth plurality of cantilever grid bars (11) mounted, at a right angle, to the fourth grid crossbeam.

3. A curing rack as claimed in claim 2, wherein, the second grid crossbeam is mounted to the first base support via the first grid crossbeam.

4. The curing rack as claimed in claim 3, wherein the second grid crossbeam is mounted to the first grid crossbeam via clamps.

5. The curing rack as claimed in claim 3, wherein the second grid crossbeam is mounted to the first grid crossbeam via strap hinges.

6. The curing rack as claimed in claim 3, wherein, the first grid crossbeam (09) has a row (23) of eyes distributed around a periphery of the first grid crossbeam (09), and the second grid crossbeam is hung to the vertical rod with hooks (24) in individual eyes of the row (23) of eyes.

7. The curing rack as claimed in claim 3, wherein the first grid crossbeam is mounted on the first base support (01) with a clamp (22).

8. The curing rack as claimed in claim 3, wherein the second grid crossbeam (09) is supported with a support plate (25) against the first grid crossbeam (09).

9. The curing rack as claimed in claim 3, wherein the base support (01) is configured to extend in a telescoping manner from a portion of the base support proximate to a location on the base support where the first grid crossbeam (09) is mounted.

10. A curing rack as claimed in claim 2, further comprising:

a vertical rod (02) projecting vertically from the first base support, wherein, the first grid crossbeam is mounted to the first base support via the vertical rod, and the second grid crossbeam is mounted to the first base support via the vertical rod.

11. The curing rack as claimed in claim 10, wherein the first grid crossbeam is mounted to the vertical rod (02) via clamps (10).

12. The curing rack as claimed in claim 10, wherein the first grid crossbeam is mounted to the vertical rod (02) via strap hinges (21).

13. The curing rack as claimed in claim 10, wherein, the vertical rod (02) has a row (23) of eyes distributed around a periphery of the vertical rod, and the first grid crossbeam is hung to the vertical rod with hooks (24) in individual eyes of the row (23) of eyes.

14. The curing rack as claimed in claim 10, wherein the first grid crossbeam is supported with a support plate (25) against the vertical rod (02).

15. The curing rack as claimed in claim 2, wherein the first base support is connected to the second base support via scissor braces (05).

16. The curing rack as claimed in claim 2, wherein the first base support is connected to the second base support via connecting rods.

17. The curing rack as claimed in claim 16, wherein the connecting rods are configured to extend in a telescoping manner.

* * * * *